US009951547B2

(12) United States Patent
Puscas et al.

(10) Patent No.: US 9,951,547 B2
(45) Date of Patent: Apr. 24, 2018

(54) ADJUSTABLE DECKLID LATCH ASSEMBLY

(71) Applicant: Ford Global Technologies, LLC, Dearborn, MI (US)

(72) Inventors: Livianu Dorin Puscas, Rochester Hills, MI (US); Kosta Papanikolaou, Huntington Woods, MI (US); Manuel Santana, Southfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 418 days.

(21) Appl. No.: 14/689,811

(22) Filed: Apr. 17, 2015

(65) Prior Publication Data

US 2016/0305168 A1 Oct. 20, 2016

(51) Int. Cl.

| | |
|---|---|
| ***E05C 3/06*** | (2006.01) |
| ***E05B 83/18*** | (2014.01) |
| ***E05B 63/00*** | (2006.01) |
| ***E05B 81/22*** | (2014.01) |
| *E05B 81/06* | (2014.01) |
| *E05B 81/34* | (2014.01) |
| *E05B 81/64* | (2014.01) |

(52) U.S. Cl.

CPC ..... *E05B 83/18* (2013.01); *E05B 63/0056* (2013.01); *E05B 81/22* (2013.01); *E05B 81/06* (2013.01); *E05B 81/34* (2013.01); *E05B 81/64* (2013.01); *Y10T 70/7062* (2015.04); *Y10T 292/1082* (2015.04); *Y10T 292/68* (2015.04)

(58) Field of Classification Search

CPC .. E05B 85/045; E05B 15/0245; E05B 15/024; E05B 2015/0275; E05B 85/04; Y10T 292/696; Y10T 292/68; Y10T 292/705; Y10T 292/699; Y10T 292/707; Y10T 292/683; Y10S 292/55

USPC ..... 292/197, 340–341.19

See application file for complete search history.

(56) References Cited

U.S. PATENT DOCUMENTS

| | | | | |
|---|---|---|---|---|
| 4,707,007 | A | 11/1987 | Inoh | |
| 4,756,565 | A | 7/1988 | Myslicki et al. | |
| 4,946,208 | A | 8/1990 | Myslicki et al. | |
| 5,193,868 | A * | 3/1993 | O'Toole | E05B 85/045 292/341.15 |
| 5,443,292 | A | 8/1995 | Shimada et al. | |
| 8,029,030 | B2 | 10/2011 | Shimura et al. | |
| 8,469,413 | B2 | 6/2013 | Novajovsky et al. | |
| 9,004,570 | B1 * | 4/2015 | Krishnan | E05B 83/18 292/201 |
| 2008/0197643 | A1 * | 8/2008 | Dennis | E05B 15/025 292/340 |

* cited by examiner

*Primary Examiner* — Mark A Williams

(74) *Attorney, Agent, or Firm* — Jason Rogers; Price Heneveld LLP

(57) ABSTRACT

A decklid assembly includes a striker that movably engages a vehicle body structure. The striker includes first and second opposed surfaces that face each other. The decklid assembly includes a decklid having a latch that releasably engages the striker. A cam is rotatably mounted to the body structure. The cam is disposed between the opposed surfaces of the striker, such that rotation of the cam in first and second directions causes the cam to engage the first and second opposed surfaces, respectively, thereby shifting the striker up and down, respectively.

17 Claims, 7 Drawing Sheets

ADJUSTABLE DECKLID LATCH ASSEMBLY

CROSS REFERENCE TO RELATED APPLICATION

This patent application is related to U.S. patent application Ser. No. 14/223,444 filed on Mar. 24, 2014, entitled "ADJUSTABLE LATCH ASSEMBLY," now U.S. Pat. No. 9,004,570, the entire disclosure of which is incorporated herein by reference.

FIELD OF THE INVENTION

The present invention generally relates to latches for decklids of motor vehicles, and more particularly, to a latch that can be adjusted to provide a required gap or margin between a decklid and a vehicle body structure.

BACKGROUND OF THE INVENTION

Vehicle decklid doors are typically movably mounted to a vehicle body structure for movement between open and closed positions. Decklid doors may include a latch mechanism that releasably engages a striker on the vehicle body structure to releasably retain the decklid in a closed position. The edge of the decklid is spaced apart from an adjacent body structure such as a body or bumper to define a gap or margin. Due to the tolerances of the numerous components in a typical decklid assembly, a relatively large margin or gap may result between the decklid and the fascia or other body structure. When a decklid is closed/slammed, the decklid may "over travel" beyond the closed position. Reducing the decklid margin too much can cause paint chipping due to decklid-to-fascia contact if the actual margin approaches the over travel of the decklid. However, the larger margins required due to tolerances and over travel may detract from the appearance of the vehicle. Accordingly, there is a need to provide reduced margin despite the tolerances in the components, while still preventing damage due to over travel during closing of the deck lid.

SUMMARY OF THE INVENTION

One aspect of the present invention is an adjustable latch assembly for decklids or other closure members of motor vehicles. The adjustable latch assembly includes a striker and a latch mechanism. The latch mechanism includes a latch base and a moveable latch member that is configured to releasably engage the striker member to retain a decklid in a closed position. The adjustable latch assembly further includes an adjustment mechanism including a cam member that is rotatably connected to a selected one of the striker and the latch base, and a movable base member that is connected to the other of the striker and the latch base. The movable base member includes an engagement surface slidably engaging the cam surface such that rotation of the cam member moves the base member to thereby shift the position of the striker and the latch base relative to the other of the striker and the latch base to thereby adjust the closed position of a decklid relative to a vehicle body structure.

Another aspect of the present invention is a decklid assembly including a striker that movably engages a body structure. The striker includes first and second opposed surfaces facing each other. The decklid assembly includes a decklid having a latch that releasably engages a striker. A cam is rotatably mounted to the body structure. The cam is disposed between the opposed surfaces of the striker, such that rotation of the cam in first and second directions causes the cam to engage the first and second opposed surfaces, respectively, and shift the striker up and down, respectively.

Another aspect of the present invention is a decklid assembly including a striker movably engaging a vehicle body structure adjacent a deck opening in the vehicle body structure and defining a position relative to the vehicle body structure. The decklid assembly further includes a decklid that is movably mounted to the vehicle body structure. The decklid includes a latch that is configured to releasably engage the striker. A threaded first connector operably interconnects the striker and the vehicle body structure such that rotation of the threaded connector shifts the striker relative to the vehicle body structure to thereby adjust the position of the striker relative to the vehicle body structure. A second connector is configured to fixedly connect the striker to the vehicle body structure and prevent further movement of the striker relative to the vehicle body structure after adjusting the position of the striker relative to the vehicle body structure.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
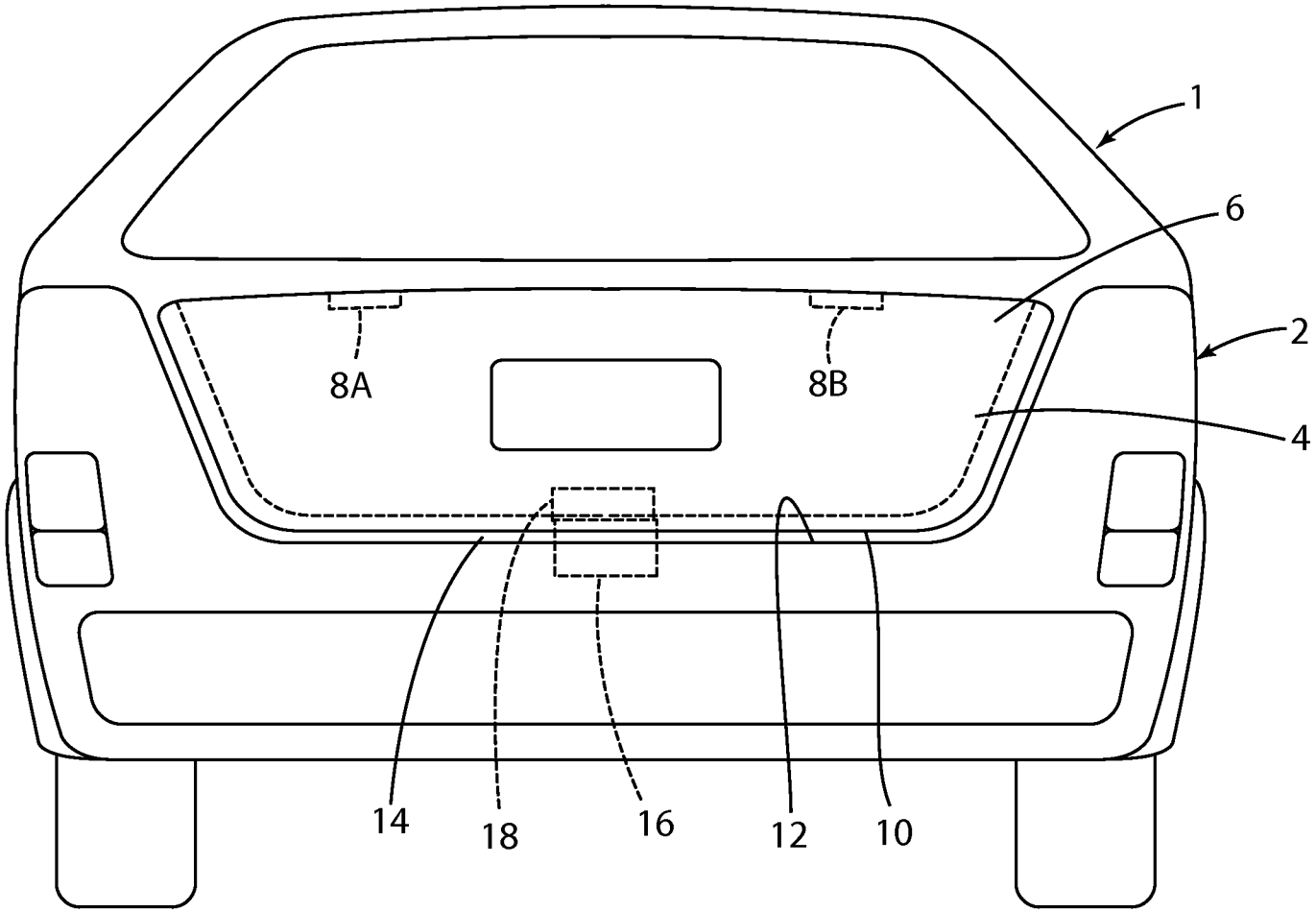
FIG. 1 is an elevational view of a vehicle showing a decklid in a closed position.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
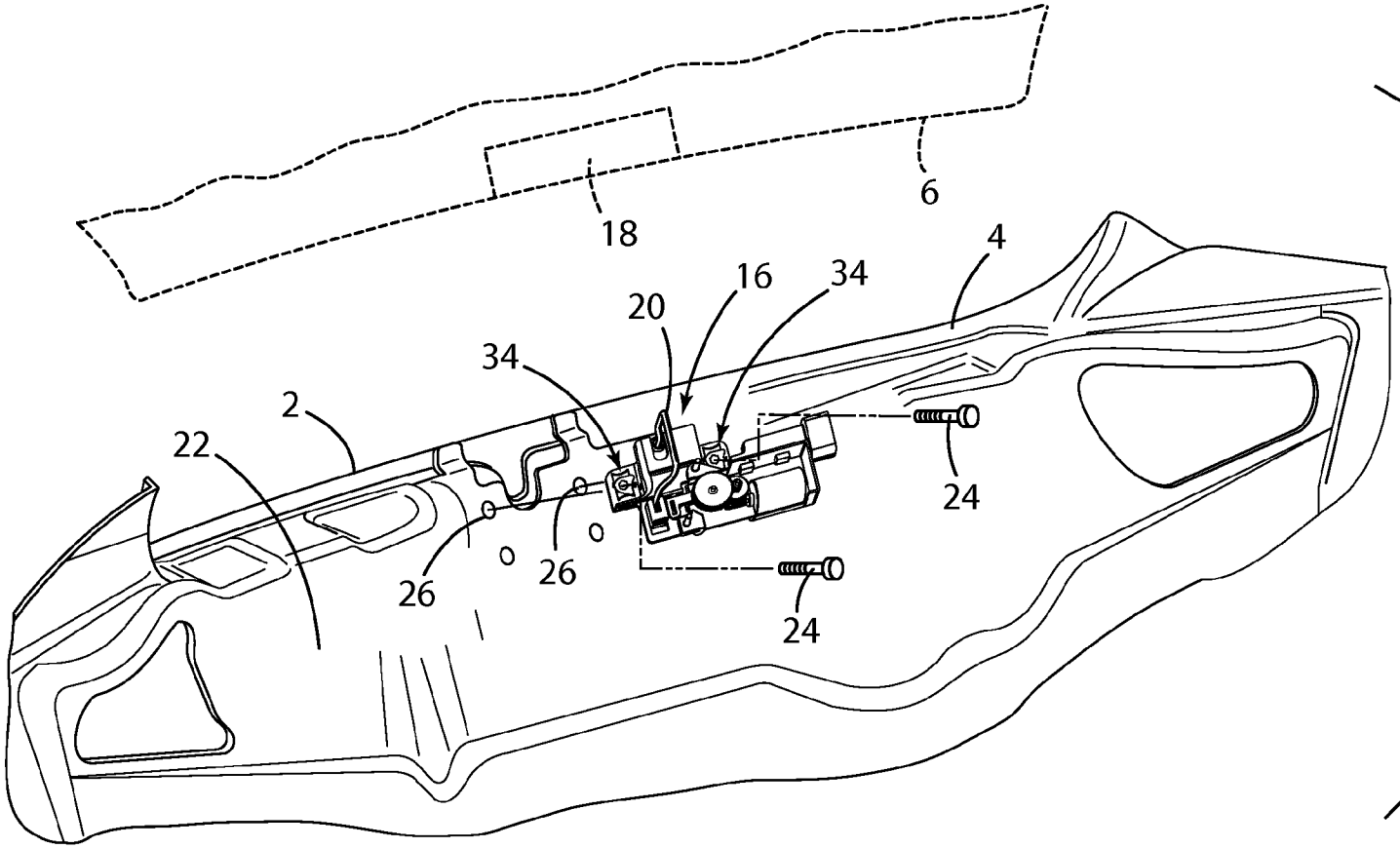
FIG. 2 is a fragmentary exploded isometric view of a striker and vehicle body structure.
Figure 3:
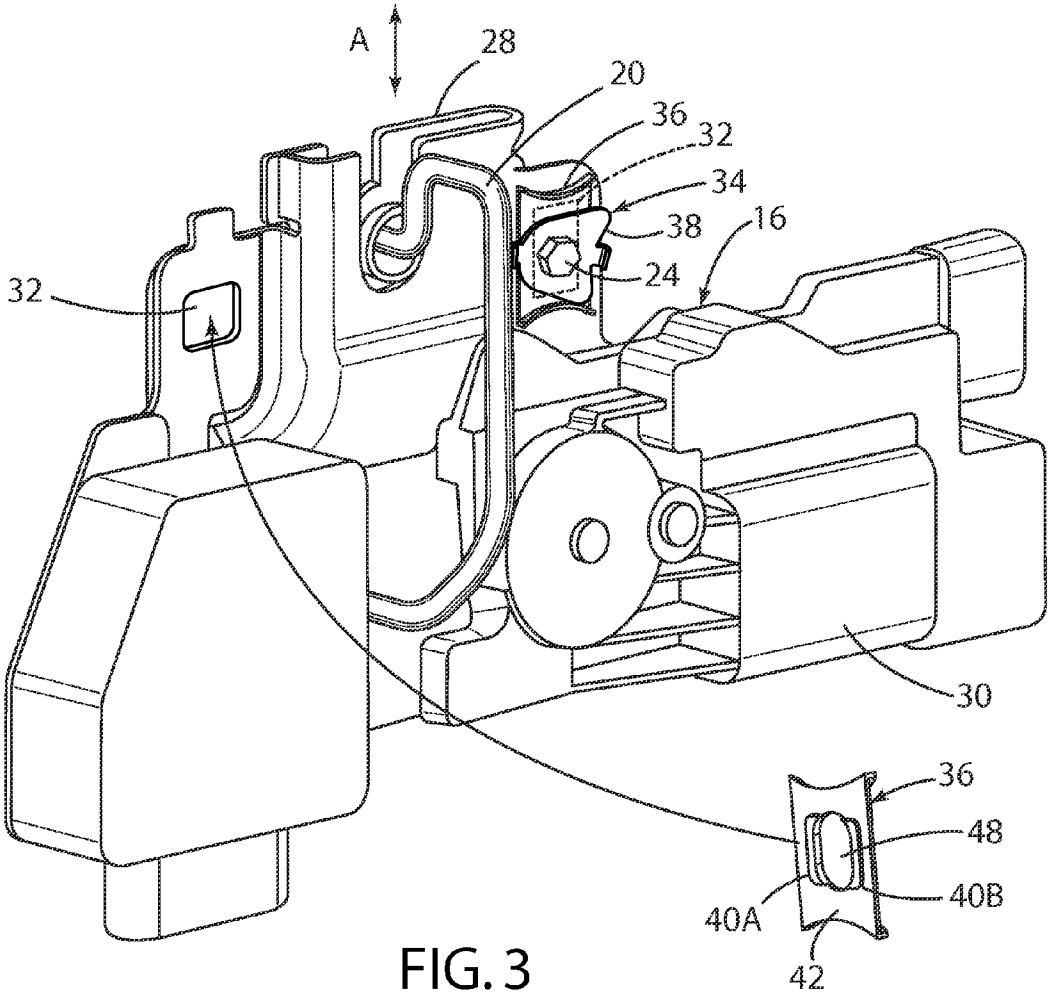
FIG. 3 is an exploded isometric view of the striker assembly of FIG. 2.

With reference to FIG. 1, a motor vehicle 1 includes a body structure 2 having one or more openings that are selectively closed off by a closure member such as a hood, a door, or a decklid 6. In the illustrated example, body structure 2 defines a rear opening 4 that is selectively closed off by a decklid 6 that is movably mounted to the body structure 2. The decklid 6 may be movably mounted to the vehicle body structure 2 by hinges 8A and 8B for rotation about a generally horizontal axis in a known manner. A lower or rear edge 10 of the decklid 6 is spaced apart from an adjacent portion 12 of the vehicle 1 to define a gap or margin 14. The body portion 12 may comprise a bumper, trim, or other portion of the vehicle 1 that is stationary, and does not move with the decklid 6. A striker 16 (see also FIG. 2) is mounted to the vehicle body structure 2 adjacent the rear opening 4, and a latch mechanism 18 is mounted to the decklid 6. In FIG. 2, the striker 16 is shown in an exploded configuration in which the striker assembly 16 is spaced apart from the body structure 2. Striker 16 may include a loop 20 that is releasably engaged by the latch mechanism 18 to retain the decklid 6 in a closed position. The striker 16 may comprise a conventional striker having a loop 20 that is fixedly mounted to the body structure 2. Alternatively, striker 16 may comprise a "cinching" striker having a loop 20 that moves upon actuation of an electric motor 30 (FIG. 3). A cinching striker is disclosed in more detail in U.S. patent application Ser. No. 14/223,444 filed on Mar. 24, 2014, entitled "ADJUSTABLE LATCH ASSEMBLY," now U.S. Pat. No. 9,004,570, the entire contents of which are incorporated herein by reference. The latch mechanism 18 may comprise a conventional latch of a known type having a releasable claw that engages the striker 16 to selectively retain the decklid 6 in a closed position. The latch mechanism 18 can be unlatched by a key, powered actuator, or other such known arrangement whereby the decklid 6 can be opened to permit access to interior space 22 through the opening 4. As discussed in more detail below, the striker assembly 16 may be secured to the body structure 2 by one or more threaded fasteners such as bolts 24 that engage/extend through adjustment assemblies 34 and threadably engage threaded openings 26 of body structure 2. The threaded openings 26 may comprise threaded nuts (e.g. clip nuts) or other suitable threaded connectors of a type known in the art.

With further reference to FIG. 3, striker assembly 16 may include a base or bracket structure 28 and a loop 20 that is movably mounted to the base or bracket structure 28. The striker assembly 16 may include a powered actuator such as an electric motor 30 and drive that shifts the loop 20 vertically as shown by the arrow "A." Alternatively, the striker assembly 16 may comprise a striker loop 20 or other suitable structure that is fixed relative to the base or bracket structure 28. In the illustrated example, a pair of adjustment assemblies 34 engage openings 32 in base or bracket structure 28 to thereby adjustably connect the striker 16 to the vehicle body structure 2. The adjustment assemblies 34 include a base such as base washer 36 and a cam such as cam washer 38. Protrusions 40A and 40B on rear side 42 of each base washer 36 are configured to fit closely into the openings 32 of base or bracket structure 28 such that movement of the base washers 36 causes movement of the striker 16. It will be understood that the base washers 36 may alternatively be integrally formed with the base or bracket structure 28. As discussed in more detail below, each base washer 36 includes a vertically elongated slot or opening 48 that receives a bolt 24.

Figure 4:
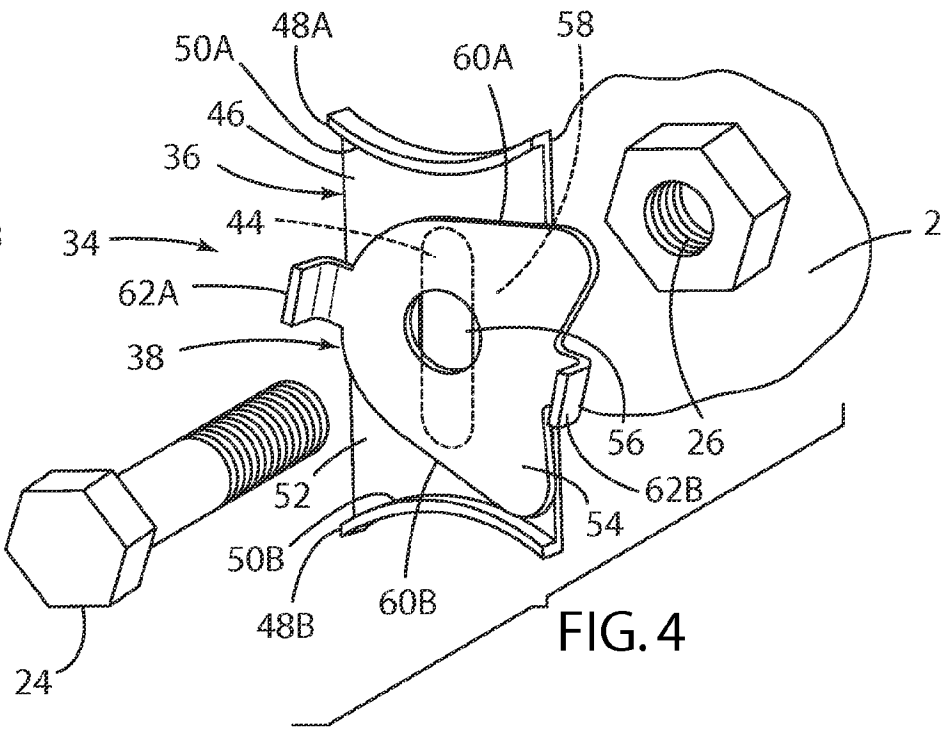
FIG. 4 is an exploded isometric view of a cam and base member.

With further reference to FIG. 4, the base washer 36 includes a flat main web or wall 46 having a generally uniform thickness, and first and second curved flanges 48A and 48B that extend transversely from the main web or wall 46. The curved flanges 48A and 48B have opposed, concavely curved first and second engagement surfaces 50A and SOB, respectively that generally face each other. Elongated opening or slot 44 extends through a central portion 52 of main web or wall 46.

Figure 11:
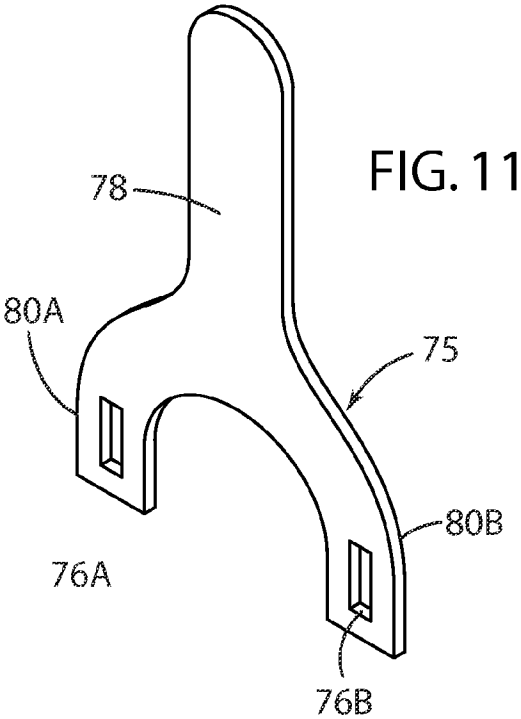
FIG. 11 is an isometric view of a tool that may be utilized to rotate the cam member.

Cam washer 38 includes a flat main web or wall portion 54 that is generally uniform thickness. A circular opening 56 is formed through a central portion 58 of the main wall 54. When assembled, threaded fastener or screw 24 extends through the opening 56 of cam washer 38, and through elongated opening or slot 44 in base washer 36, and threadably engages threaded opening 26 which is fixed to body structure 2. When assembled, the cam washer 38 is disposed between the engagement surfaces 50A and SOB of base washer 36. The cam washer 38 includes first and second cam surfaces 60A and 60B that are configured to engage the engagement surfaces 50A and SOB, respectively, of cam washer 38 as the cam washer 38 is rotated. Cam washer 38 may include a pair of protrusions such as tabs 62A and 62B that extend transversely from the main web or wall 54 of cam washer 38. As discussed in more detail below, a tool 75 (FIG. 11) has a pair of openings 76A and 76B that engage tabs 62A and 62B, respectively, to thereby permit rotation of cam washer 38. Base washer 36 and cam washer 38 may comprise steel or other suitable material.

Figure 6:
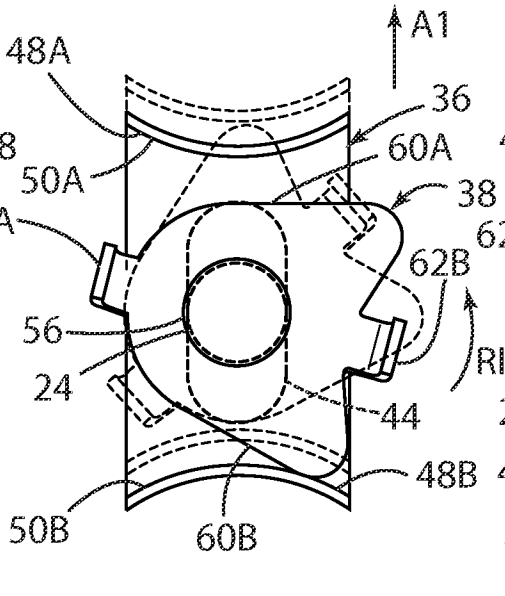
FIG. 6 is a plan view of a cam and base member showing the cam in a second position.
Figure 5:
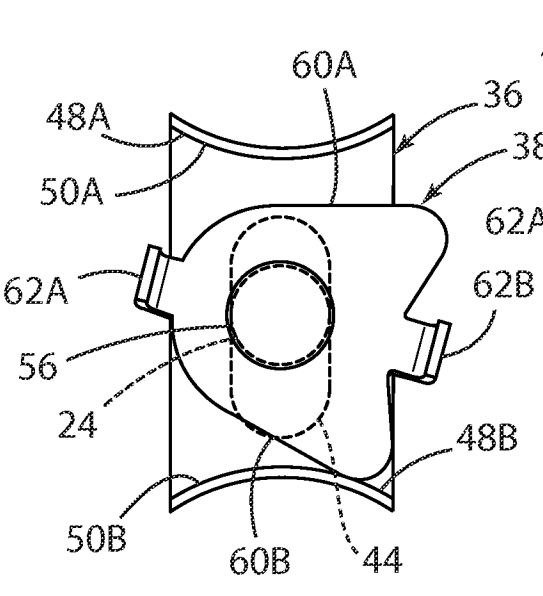
FIG. 5 is a plan view of a cam and base member showing the cam in a first position.

With further reference to FIGS. 5-9, during assembly striker 16 is initially assembled to the body structure by inserting the threaded fasteners 24 through openings 56 of cam washer 38, and through elongated openings 44 of base washers 36. The threaded fasteners 24 are initially not tightened, such that the cam washer 38 is rotatably supported by the threaded fastener 24. As shown in FIG. 6, if cam washer 38 is rotated in a first direction "R1," the first cam surface 60A slidably engages engagement surface 50A of base washer 36, thereby causing the base washer 36 to shift in the direction of the arrow "A1." Because protrusions 40A and 40B (FIG. 3) of base washer 36 are closely received in openings 32 of bracket structure 28, movement of base washer 36 results in movement of loop 20 of striker 16. The elongated opening or slot 44 in base washer 36 permits linear movement of base washer 36 in the direction of the arrow A1. However, the circular opening 56 in cam washer 38 constrains the cam washer 38 so it rotates about the threaded fastener 24.

Figure 7:
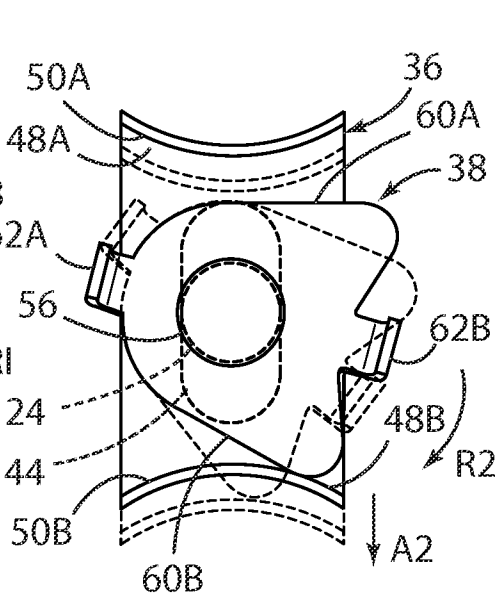
FIG. 7 is a plan view of a cam and base member showing the cam in a third position.

With further reference to FIG. 7, if cam washer 38 is rotated in a second direction as shown by the arrow "R2," the second cam surface 60B of cam washer 38 slidably engages the second engagement surface 50B of base washer 36, thereby shifting the base washer 36 in the direction of the arrow "A2." As discussed above, the base washer 36 includes protrusions 40A and 40B (FIG. 3) that are received in openings 32 of base bracket or structure 28 of striker 16.

Thus, movement of the base washer 36 in a second direction A2 (FIG. 7) causes the striker assembly 16 to also move in the second direction A2.

During vehicle assembly the fasteners 24 can be loosely assembled, and the latch 18 can be engaged with the striker 16. The cam washer 38 can then be rotated to adjust (increase or decrease) the size of the gap or margin 14 (FIG. 1) between the decklid 6 and the adjacent body portion or structure 12.

After the gap or margin 14 (FIG. 1) is adjusted to the desired dimension, the fasteners 24 can be tightened to thereby clamp the cam washer 38 and base washer 36 to the body structure 2. When the cam washer 38 and base washer 36 are clamped due to tightening of threaded fastener 24, additional rotation of cam washer 38 is not possible, and the position of the striker assembly 16 relative to the vehicle body 2 is therefore fixed due to tightening of the threaded fastener 24.

Tool 75 (FIG. 11) may be utilized to rotate the cam washer 38. In the illustrated example, tool 75 has an elongated handle 78, and a pair of extensions 80A and 80B having openings 76A and 76B, respectively, therethrough. The openings 76A and 76B receive the tabs 62A and 62B of cam washer 38, and a user can rotate the tool 75 to thereby rotate the cam washer 38. It will be understood that the configuration of the tool 75 may vary as required for a particular application. In particular, the handle 78 and/or other portions of the tool 75 maybe curved or bent as required to provide access to the cam washers 38.

Figure 10:
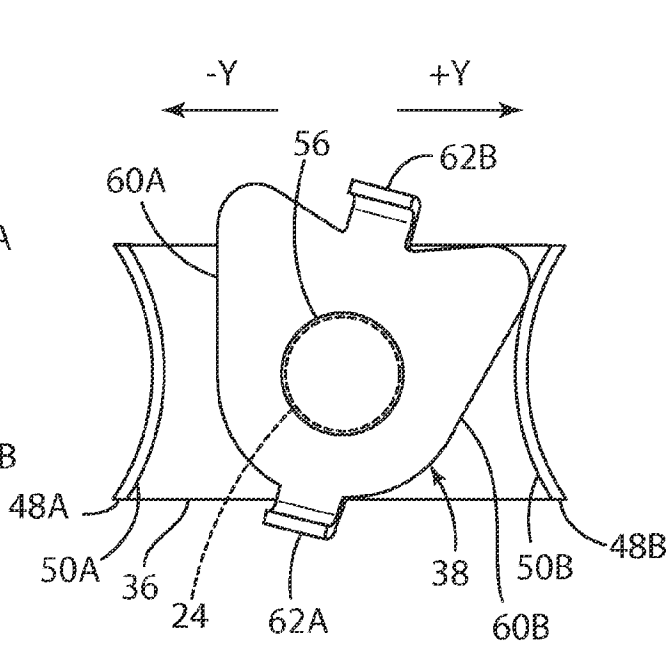
FIG. 10 shows a cam member and base member oriented for side-to-side adjustment of the position of the base member.
Figure 9:
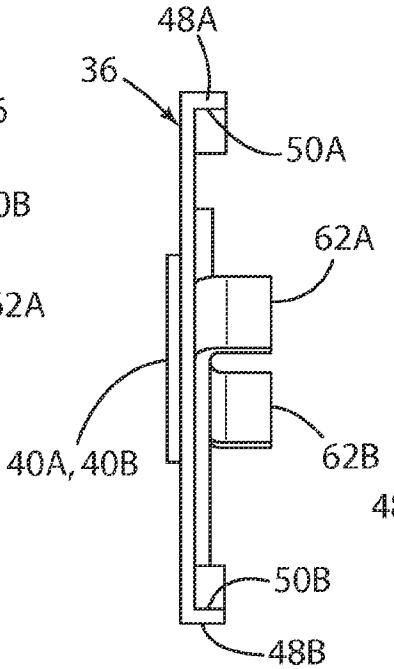
FIG. 9 is a side elevational view of the cam and base member of FIG. 5.
Figure 8:
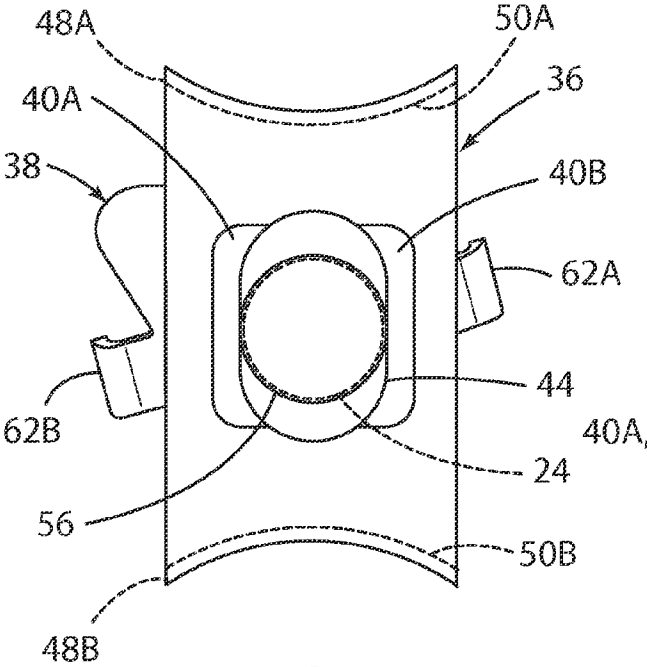
FIG. 8 shows the cam and base member of FIG. 5 viewed from the opposite side relative to FIG. 5.

In FIGS. 6 and 7, the directions A1 and A2 generally correspond to up and down movement, respectively, of striker 16 that provide increases and decreases, respectively of the size of gap 14. However, as shown in FIG. 10, the base washer 36 and cam washer 38 may also be mounted to provide side-to-side adjustment as shown by the arrows "−Y" and "+Y." Side-to-side adjustment can be utilized to adjust the size of the gaps along the sides of decklid 6.

Figure 12:
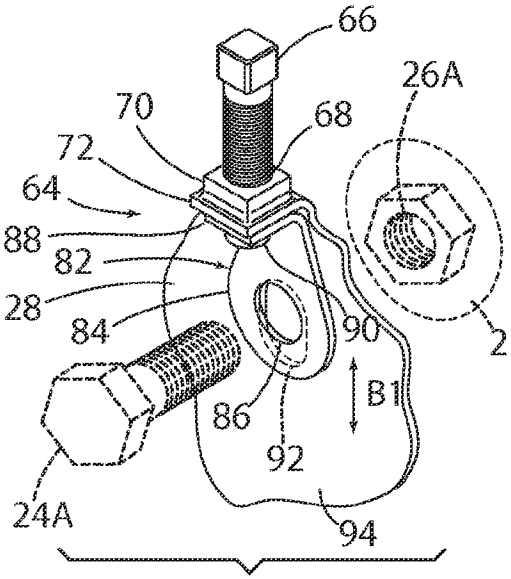
FIG. 12 is a fragmentary, exploded isometric view of an adjustable connector according to another aspect of the present invention in a first configuration.

With further reference to FIG. 12, an adjustment assembly 64 according to another aspect of the present invention includes a first threaded member 66 that threadably engages a threaded opening 68 of a nut 70 or the like that is secured to a tab 72 formed in the base or bracket structure 28 of striker assembly 16. A connector member 82 includes a first portion 84 having a circular opening 86, and a second portion or tab 88 that is rotatably connected to an end 90 of first threaded member 66 such that rotation of first threaded member 66 shifts the connector 82 in the direction of the arrow "B1." A threaded fastener 24A extends through opening 86 of connector 82, and through an elongated slot 92 in a sidewall 94 of base or bracket structure 28. The threaded fastener 24 threadably engages a threaded opening 26A formed in vehicle body structure 2.

Figure 14:
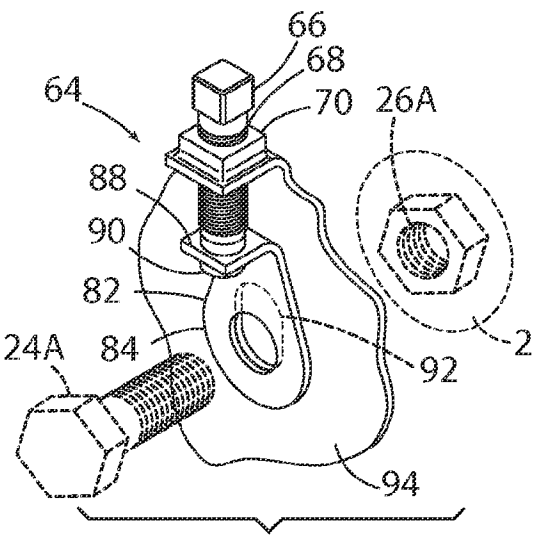
FIG. 14 is a fragmentary, exploded isometric view of an adjustable connector according to another aspect of the present invention in a third configuration.
Figure 13:
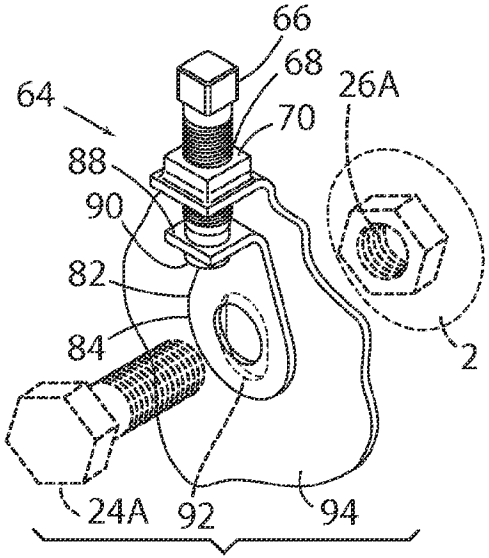
FIG. 13 is a fragmentary, exploded isometric view of an adjustable connector according to another aspect of the present invention in a second configuration.

As discussed above, rotation of first threaded member 66 causes the base or bracket structure 28 to move relative to the connector 82. The position of the connector 82 is fixed relative to the vehicle body structure 2 due to the engagement of threaded fastener 24A with opening 86 of first connector 82. Thus, rotation of first threaded member 66 causes movement of the striker 16 in the direction of the arrow "B1." Threaded fastener 24A can initially be loosely engaged with threaded opening 26A in vehicle body 2. After the position of striker 16 is set by rotation of first threaded member 66 to provide the required gap or margin 14, the threaded fastener 24A can be fully tightened to thereby lock the position of the striker 16 relative to the body structure 2. In FIG. 12, the base or bracket structure 28 of striker 16 is adjusted to a lower most position. In FIG. 13, the base or bracket structure 28 of striker 16 is adjusted to a central location relative to the body structure 2. In FIG. 14, the base or bracket structure 28 of striker 16 is adjusted to an upper most position relative to the body structure 2. The length of the first threaded member 66 and the length of the elongated opening or slot 92 in sidewall 94 of base or bracket structure 28 can be varied as required to provide the desired range of adjustability with respect to the position of striker 16 relative to the body structure 2.

In the examples discussed above in connection with FIGS. 1-14, a pair of the adjustment assemblies 34 adjustably interconnect the striker 16 with the vehicle body 2. However, it will be understood that the adjustment assemblies 34 may also be utilized to adjustably interconnect the latch mechanism 18 to the lid 6 to thereby adjust the margin 14. Furthermore, it will be understood that the striker 16 may be mounted to the decklid 6, and the latch mechanism 18 may be mounted to the vehicle body structure 2. Still further, it will be understood that the adjustment mechanisms of the present invention are not limited to decklids. For example, the adjustment mechanisms may be utilized in connection with hoods, doors, or other closure members having releasable latch mechanisms that releasably engage a striker or other such feature to retain the closure member in a closed position. Also, as used herein, the term decklid may refer to a trunk lid, a rear hatch (e.g. with a window), a hood, or virtually any other movable member of the type that is movably mounted to a vehicle structure.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. An adjustable latch assembly for closure members of motor vehicles, the adjustable latch assembly comprising:

a striker member;

a latch mechanism having a latch base and a movable latch member that is configured to releasably engage the striker member to retain a closure member in a closed position; and an adjustment mechanism including a cam member having a cam surface, wherein the cam member is rotatably connected to a selected one of the striker and the latch base, and a movable base member that is connected to the other of the striker and the latch base, and wherein the movable base member includes an engagement surface slidably engaging the cam surface such that rotation of the cam member moves the base member transverse to the axis and shifts the position of the striker and the latch base relative to the other of the striker and the latch base to thereby adjust the closed position of a closure member relative to a vehicle body structure.

2. The adjustable latch assembly of claim 1, including:

a pivot member configured to be mounted to a vehicle body structure adjacent an opening; and wherein:

the cam member has a central opening and the pivot member extends through the central opening such that the cam member rotatably engages the pivot member.

3. An adjustable latch assembly for closure members of motor vehicles, the adjustable latch assembly comprising:

a striker member;

a latch mechanism having a latch base and a movable latch member that is configured to releasably engage the striker member to retain a closure member in a closed position;

a pivot member configured to be mounted to a vehicle body structure adjacent an opening;

a first threaded member configured to be mounted to a vehicle body structure;

an adjustment mechanism including a cam member having a cam surface, wherein the cam member is rotatably connected to a selected one of the striker and the latch base, and a movable base member that is connected to the other of the striker and the latch base, and wherein the movable base member includes an engagement surface slidably engaging the cam surface such that rotation of the cam member moves the base member to thereby shift the position of the striker and the latch base relative to the other of the striker and the latch base to thereby adjust the closed position of a closure member relative to a vehicle body structure, wherein the cam member rotatably engages the pivot member; and wherein:

the pivot member comprises a second threaded member that is configured to threadably engage the first threaded member and clamp the cam member to prevent additional rotation of the cam member following adjustment.

4. The adjustable latch assembly of claim 3, wherein:

the cam surface is non-circular.

5. The adjustable latch assembly of claim 3, wherein:

the cam member includes first and second cam surfaces; and the movable base member includes first and second engagement surfaces that are configured to engage the first and second cam surfaces, respectively, upon rotation of the cam member in first and second directions, respectively, to shift the movable base member in first and second directions, respectively.

6. The adjustable latch assembly of claim 5, wherein:

the first and second engagement surfaces face each other; and the cam member is disposed between the first and second engagement surfaces.

7. The adjustable latch assembly of claim 6, wherein:

the first and second engagement surfaces are convex.

8. The adjustable latch assembly of claim 7, wherein:

the movable base member comprises a main web having an opening through a central portion of the web;

the cam member has an opening therethrough; and the second threaded member extends through the openings in the movable base member and the cam member.

9. The adjustable latch assembly of claim 8, wherein:

the opening through the movable base member comprises an elongated slot.

10. A decklid, comprising:

a striker movably engaging a body structure and including first and second opposed surfaces facing each other;

a decklid having a latch releasably engaging the striker; and a cam rotatably mounted to the body structure and engaging the first and second opposed surfaces and shifting the striker up and down when the cam rotates, the cam including a pair of transversely extending tool engagement surfaces engageable by a tool to rotate the cam.

11. The decklid assembly of claim 10, including:

a pivot member mounted to the body structure; and wherein:

the cam rotatably engages the pivot member.

12. The decklid assembly of claim 11, wherein:

the pivot member comprises a threaded member that threadably engages the body structure, and wherein the threaded member can be tightened to clamp the cam and prevent rotation of the cam.

13. The decklid assembly of claim 12, wherein:

the striker includes an elongated slot, and wherein the threaded member extends through the elongated slot.

14. The decklid assembly of claim 10, wherein:

the cam includes first and second outwardly facing cam surfaces on opposite sides of the cam that slidably engage the opposed surfaces of the striker.

15. The decklid assembly of claim 14, wherein:

the first and second cam surfaces taper outwardly away from each other.

16. A decklid assembly, comprising:

a striker movably engaging a vehicle body structure adjacent a deck opening in the vehicle body structure and defining a position relative to the vehicle body structure;

a decklid movably mounted to the vehicle body structure and including a latch that is configured to releasably engage the striker;

a threaded first connector operably interconnecting the striker and the vehicle body structure such that rotation of the threaded connector shifts the striker relative to the vehicle body structure to thereby adjust the position of the striker relative to the vehicle body structure;

a second connector configured to fixedly connect the striker to the vehicle body structure and prevent further movement of the striker relative to the vehicle body structure after adjusting the position of the striker relative to the vehicle body structure;

a connector member having an opening; and wherein:

the vehicle body structure includes a threaded first opening;

the striker includes a threaded second opening and an opening in the form of an elongated slot adjacent the threaded second opening;

the threaded first connector having a shaft portion threadably engaging the threaded second opening and an end portion that rotatably engages the connector member; and the second connector comprises a threaded second member extending through the opening in the connector member and through the elongated slot and threadably engaging the threaded first opening.

17. The decklid assembly of claim 16, wherein:

the threaded second member can be tightened to clamp the connector member and the striker to the vehicle body structure.

* * * * *